US007987523B2

(12) United States Patent
Cole et al.

(10) Patent No.: US 7,987,523 B2
(45) Date of Patent: Aug. 2, 2011

(54) QUICK RELEASE GARMENT

(75) Inventors: Michael E. Cole, St. Genevieve, MO (US); Matthew A. Johnson, Milford, PA (US)

(73) Assignee: Eagle Industries Unlimited, Inc., Fenton, MO (US)

( * ) Notice: Subject to any disclaimer, the term of this patent is extended or adjusted under 35 U.S.C. 154(b) by 1225 days.

(21) Appl. No.: 11/627,356

(22) Filed: Jan. 25, 2007

(65) Prior Publication Data

US 2011/0094006 A1 Apr. 28, 2011

Related U.S. Application Data

(63) Continuation-in-part of application No. 11/278,905, filed on Apr. 6, 2006, now Pat. No. 7,243,376, which is a continuation of application No. 10/604,283, filed on Jul. 8, 2003, now Pat. No. 7,047,570.

(51) Int. Cl.
*A41D 1/04* (2006.01)

(52) U.S. Cl. ..... 2/102; 2/462

(58) Field of Classification Search ..... 2/102, 462, 2/463, 464, 465, 467, 455, 2.5; 450/17, 26, 450/28, 36, 46, 58, 71, 86, 88
See application file for complete search history.

(56) References Cited

U.S. PATENT DOCUMENTS

| | | | |
|---|---|---|---|
| 761,113 | A | 5/1904 | Van Wagoner et al. |
| 842,498 | A | 1/1907 | Schmidt |
| 1,776,044 | A | 9/1930 | Roehm |
| 2,148,152 | A | 2/1939 | Dosberg |
| 2,343,142 | A | 2/1944 | Freedman |
| 2,442,895 | A | 6/1948 | Hill |
| 2,654,964 | A | 10/1953 | Stoll |
| 3,934,848 | A | 1/1976 | Snyder |
| 4,044,478 | A | 8/1977 | Girard |
| 4,117,609 | A | 10/1978 | Helt |
| 4,262,865 | A | 4/1981 | Smith |
| 4,497,069 | A | 2/1985 | Braunhut |

(Continued)

FOREIGN PATENT DOCUMENTS

CA 642244 6/1962

OTHER PUBLICATIONS

Point Blank Body Armor, Inc., Nato QR Full Spectrum Battle Equipment, web site printout dated Nov. 5, 2003.

(Continued)

*Primary Examiner* — Gary L Welch
*Assistant Examiner* — Andrew Collins
(74) *Attorney, Agent, or Firm* — Husch Blackwell LLP

(57) ABSTRACT

A quick release garment such as a vest including a quick release system for easy removal by a wearer in an emergency situation wherein activation of the quick release system releases the vest from one side only disconnecting one shoulder strap, at least one belt end portion and at least one cummerbund end portion, if a cummerbund is present. Components of the vest remain attached together so that the wearer may easily retrieve the garment, once removed, and easily reposition and reconnect the garment for movement to another location. The present garment can also be configured such that the quick release system releases only one shoulder strap, a shoulder strap and one or both belt end portions, a shoulder strap and one or both cummerbund end portions, and other combinations.

17 Claims, 6 Drawing Sheets

U.S. PATENT DOCUMENTS

| | | | |
|---|---|---|---|
| 4,545,773 | A | 10/1985 | Evert |
| 4,697,285 | A | 10/1987 | Sylvester |
| 5,060,314 | A | 10/1991 | Lewis |
| 5,259,093 | A | 11/1993 | D'Annunzio |
| 5,495,621 | A | 3/1996 | Kibbee |
| 5,512,348 | A | 4/1996 | Mazelsky |
| 5,516,234 | A | 5/1996 | Duchesne |
| 5,724,707 | A | 3/1998 | Kirk et al. |
| 5,785,011 | A | 7/1998 | Gitterman, III |
| 5,806,740 | A | 9/1998 | Carlson |
| 5,897,468 | A | 4/1999 | Lumpkin |
| 5,966,747 | A | 10/1999 | Crupi et al. |
| 6,029,270 | A | 2/2000 | Ost et al. |
| 6,035,452 | A | 3/2000 | Braxton |
| 6,098,196 | A | 8/2000 | Logan |
| 6,164,048 | A | 12/2000 | Rhodes |
| 6,185,738 | B1 | 2/2001 | Sidebottom |
| 6,308,334 | B1 | 10/2001 | Maas |
| 6,421,833 | B2 | 7/2002 | Khanamirian et al. |
| 6,769,137 | B2 | 8/2004 | D'Annunzio |
| 6,948,188 | B2 | 9/2005 | D'Annunzio |
| 7,020,897 | B2 | 4/2006 | Johnson |
| 7,047,570 | B2 | 5/2006 | Johnson |
| 7,243,376 | B2 * | 7/2007 | Johnson ..... 2/102 |
| 2007/0107109 | A1 | 5/2007 | Johnson |

OTHER PUBLICATIONS

U.S. Army Natick Soldier Center, USMC Full Spectrum Battle Equipment, web site printout (several views are included). This body armor/vest is believed to be the vest produced by Point Blank Body Armor, Inc.

Attachment A1-A8 show Point Blank Body Armor, Inc., Nato QR Full Spectrum Battle Equipment, Digital photograph with details of cable release system using multiple cables taken Jul. 2004.

Figures B1-B3, for Cut Away Vest (digital photographs).

Figures C1-C7, for Cut Away Vest (digital photographs).

Figures D1-D6 illustrate the DAP vest discussed in the background of the subject application.

Attachments E1-E11 show what is believed to be an M1 flak jacket used in the latter part of World War II by American flyers.

Attachments F1-F4 show World War II flak jackets including the M1 flak jacket and the M12.

Attachment G1-G10 illustrates a releasable vest apparently produced by Point Blank Body Armor, Inc.

* cited by examiner

QUICK RELEASE GARMENT

CROSS REFERENCE TO RELATED APPLICATIONS

This application is a continuation-in-part of application Ser. No. 11/278,905 filed Apr. 6, 2006 now U.S. Pat. No. 7,243,376 and currently pending; said application Ser. No. 11/278,905 being a continuation of application Ser. No. 10/604,283 filed Jul. 8, 2003, now issued on May 23, 2006 as U.S. Pat. No. 7,047,570; the entire disclosures of which are incorporated herein by reference.

BACKGROUND OF THE INVENTION

A quick release vest that may be simply and quickly removed in an emergency situation. The vest is particularly usable in tactical and military operations.

Vests, particularly those used in tactical and military operations are well known. The vests are used to carry personal supplies and equipment, for example, ammunition clips, flashlights, radios and first aid supplies. The vest can also be used to carry bullet resistant armor to help protect the wearer from being wounded in vital body areas. However, the vests have drawbacks. In older vests, one problem encountered was that the weight of the vest, when loaded with supplies, has caused soldiers to drown not only because of the weight of the vest, but also because of the soldiers inability to quickly remove the vest in an emergency situation.

Proposals have been made to improve such vests. Such a vest is disclosed in U.S. Pat. No. 7,047,570. The vest disclosed in this patent can also permit cutaway of the vest, that is, the front and rear portions can separate completely from one another while the waist belt and cummerbund have an end that separates from at least one of the front and rear portions. This vest uses a single cable, single point of release construction. While providing an advance in the art, the structure of the vest of U.S. Pat. No. 7,047,570 can present problems under some circumstances of use.

One problem in the use of the above discussed vest is that when the release system is activated, the vest is in at least two disconnected pieces. Thus, the original wearer of the vest, in order to regain possession and take the vest with him/her, must pick up a plurality of parts which may be difficult in some situations, like, when under hostile fire. The leaving behind of a vest and its supplies may be critical to the survival of the vest wearer. Thus, there is a need for an improved vest.

SUMMARY OF THE INVENTION

The present invention involves the provision of a quick release garment, for example, a vest, usable for carrying supplies and equipment and is constructed for quick release from the wearer in a manner that at least the major portions of the vest remain attached to one another.

In one embodiment, the garment includes front and rear torso panels connected together around the waist of a wearer by a waist belt. A cummerbund may also be provided or the cummerbund could be the waist belt. Shoulder straps are provided to connect together the front torso panel to the rear torso panel adjacent the top of the vest. The waist belt, and/or cummerbund and front and rear torso panels are connected together by a connector device that may be easily separated from retaining the various components together by the activation of a retainer device. Activation of the retainer device will release one of the shoulder straps connecting the rear and front torso panels together while the other shoulder strap remains attached. The retainer device may also be used to separate one end of the waist belt from one of the torso panels as well as a cummerbund if a cummerbund is used. It is preferred that a shoulder strap, cummerbund and/or waist belt be releasably connected at a common point through cooperation of a connector device and the retainer device.

The present invention also may provide a vest with an easily reconnectable shoulder strap not requiring reassembly of the retainer device and cooperating connector device so that a vest user may easily remount the vest and wear the vest in a temporarily connected manner for exit from a danger zone, hostile fire area or the like.

BRIEF DESCRIPTION OF THE DRAWINGS

Like numbers throughout the various Figures designate like or similar parts and/or construction.

DETAILED DESCRIPTION

The following detailed description and associated drawings of the present invention are related to certain embodiments or implementations of the invention. Accordingly, the following description and associated drawings do not describe every conceivable and possible embodiment or implementation of the invention. Those of ordinary skill in the art, given the teachings herein, will recognize that aspects of the present invention may be changed or otherwise adapted to best-fit a particular implementation of the present invention.

Figure 1:
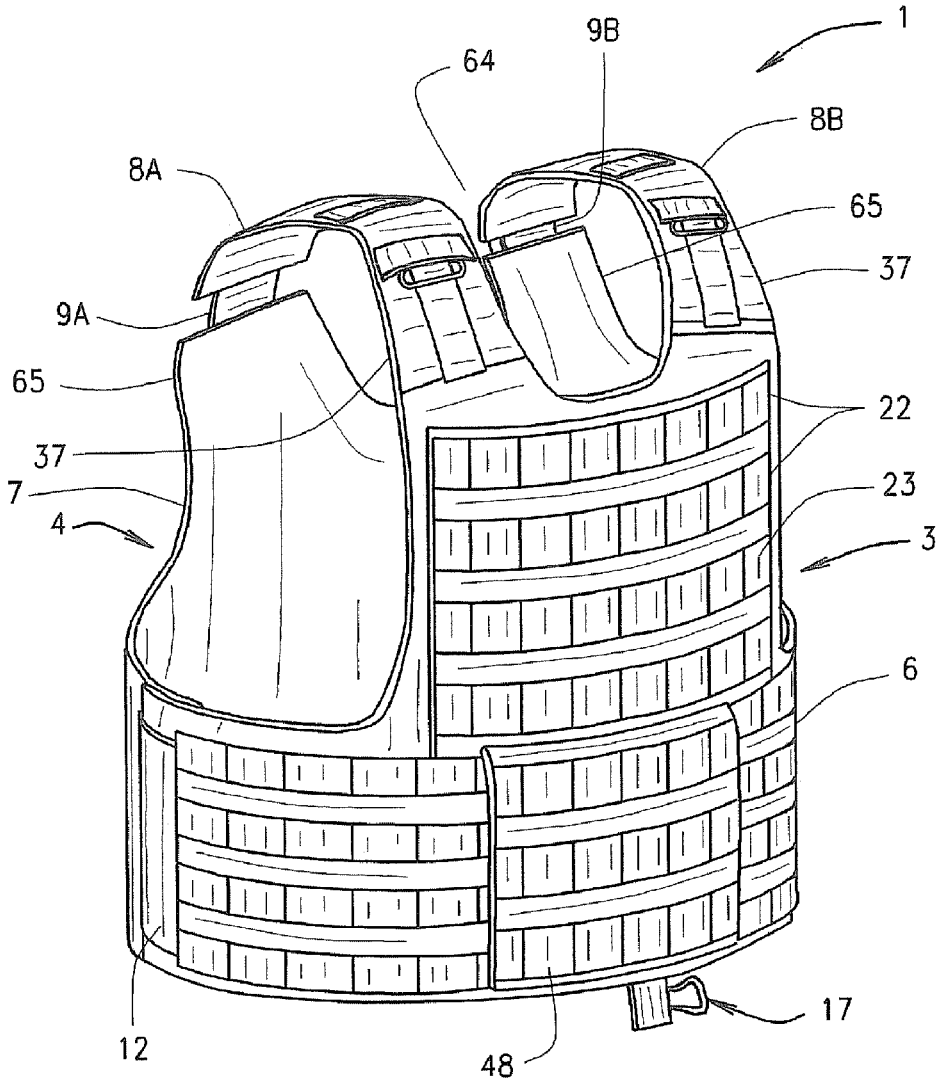
FIG. 1 is a front perspective view of a vest configured for wearing made in accordance with the teachings of the present invention.
Figure 3:
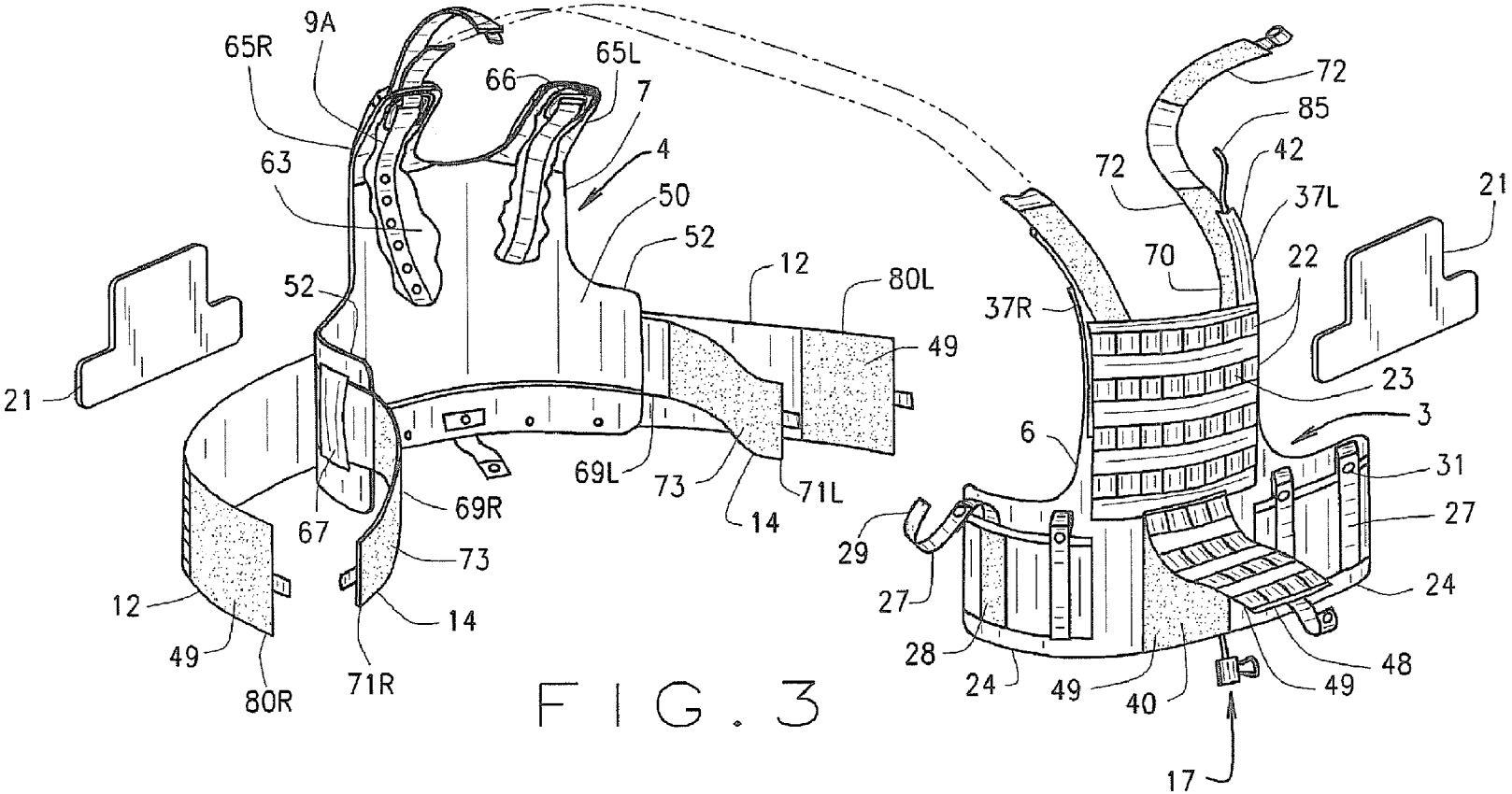
FIG. 3 is an exploded fragmentary perspective view of the vest of FIG. 1 showing further details of the vest generally from the front of the vest.

The reference numeral 1 designates generally a quick release garment which is shown as being in the form of a vest having a front torso member 3 and a back torso member 4. Although the garment is shown as a vest, it is to be understood that the garment could be a pack, backpack or other device worn or wearable by a user utilizing over the shoulder support and at least one waist securement device as described below. The front torso member 3 includes a front torso panel 6 and the back torso member 4 includes a back or rear torso panel 7. The front and back members 3 and 4 are connected together by a pair of laterally spaced shoulder strap systems 8A, 8B including shoulder strap elements 9, designated 9A and 9B for convenience, and a waist belt 12. An internal belt or cummerbund 14 (FIG. 3) may be provided to help secure the back member 4 to the vest wearer. Quick release system means designated generally 17 (FIG. 1) is provided to effect separation of portions of the vest 1 from one another so that the vest 1 may be easily and quickly removed from the wearer particularly in an emergency situation. The vest 1 is constructed to preferably be usable to attach accessory pouches and equipment thereto if desired. Bullet resistant armor 21 (FIG. 3) may also be provided in both the front and back torso panels 6 and 7.

The front member 3 is comprised of a front torso panel 6 formed of multiple overlying layers of sewn fabric. The front member 3 may also be provided with a plurality of both vertically and horizontally oriented rows of loops 22 for use with Molle System accessories, FIGS. 1 and 2. The loops 22 are formed by horizontally extending webs 23 sewn to the torso panel 6. The front member 3 may also be provided with rearwardly extending side portions 24 (FIG. 3) for wrapping partially around the waist of the wearer. The side portions 24 may be provided with accessory pouches integrally formed thereon. Attachment devices 27 (FIG. 3) may be provided to assist in attaching equipment to the vest 1. The attachment devices 27 are shown as webs working in combination with hook and loop fastener strips 28 and 29. An attachment device 27 may also utilize snap connectors 31 to permit removal of a portion thereof. Use of hook and loop fasteners allows for adjustment of the length and the position of attachment of accessories. Pouches (not shown) may also be provided. The front member 3 may also be provided with an internal pouch (not shown) for holding the armor 21. The shoulder strap systems 8 include front strap portions 37 which are formed as part of the front member 3 as upwardly and rearwardly extending ears that can be in the form of sleeves.

The front torso member 3 is preferably provided with an attachment device 40 (FIG. 3) positioned on the inside of the front member 3 adjacent the middle for help in securing and carrying a portion of the quick release means 17 for ready access by the wearer. A guide channel 42 (shown schematically in FIG. 4) which is in the form of a sewn elongate tube is part of the front member 3 and is used to receive a portion of the quick release means 17 to retain it to the front member 3 and form a pathway for movement of a portion of a quick release means 17 therethrough as later described. The attachment device 40 may also be used to releasably secure a portion of the waist belt 12 thereto as later described. A cover 48 may be provided on the front member 3 to cover portions of the waist belt 12 thereunder and to help retain the connection of the waist belt end portions 80L and 80R to one another and to the vest front torso member 3. The attachment device 40 may include hook and loop material elements 49 and the cover 48 may also be provided with hook and loop fastener element 49 as well as the waist belt 12 whereby the cover 48 may be secured to the attachment device 40 and yet be releasably attached thereto. The front member 3 of vest 1 may also be lined with mesh lining to both form a pouch and for comfort of the wearer.

The back torso member 4 (FIGS. 3 and 5) includes the back torso panel 7. At the lower portion of the back member 4 there are forwardly extending side portions 52 which will wrap partially around the waist of the wearer and project forwardly of the back torso panel 7 during use. On the lower portion of the back member 4 there is also provided a pair of generally horizontal and aligned sleeves 55 (FIG. 5) for receipt therethrough of portions of the cummerbund 14 and waist belt 12. There is an opening or gap 57 between the inside edges of the sleeves 55 for a purpose later described. On opposite sides of the opening 57 there are provided attachment devices such as hook and loop fastener elements 60 which will releasably retain a cover flap 61 (FIG. 5) in overlying relation to the opening 57 allowing the opening 57 to be selectively exposed and covered. The back torso member 4 further contains a pouch 63, (FIGS. 3 and 5) for holding armor 21 when desired. As with the front member 3, the inside surface of the back member 4 may be provided with a mesh lining 50. Additional pouches (not shown) may be formed between the mesh lining 50 and the remainder of the back member 4 for storing accessories or supplies.

Ears 65 (denoted also as 65R and 65L for differentiation) in the form of flat tubes are provided adjacent the upper edges of the main portion of the back torso panel 7 which extend upwardly and forwardly and are separated laterally, as are strap portions 37, to form an opening 64 (FIG. 1) for the neck of a wearer. The ears 65 and front strap portions 37 may be padded for comfort if desired as may portions of the shoulder straps 9 that are exposed for contact with a wearer's shoulders. The ears 65, strap portions 37 and shoulder straps 9 are parts of the strap systems 8. The exterior of the back member 4 may be provided with vertically and horizontally spaced loops 22 as found on the front member 3 as described above. The loops 22 on the back torso member 4 may be utilized for the attachment of accessory pouches or equipment and accessories to the vest 1. Sleeves 67 (FIG. 5) are formed on the back side portions 52 for receipt of portions of the cummerbund 14 therethrough and to help separate the cummerbund from the waist belt 12, if desired, and also provide support for the back member 4 during use by the wearer. The sleeves 67 are aligned with one another and have an access generally parallel to and preferably in line with the access to the belt sleeves 55 and extend generally horizontally when the vest is in its normal upright orientation. The remainder of the cummerbund 14 inside the back member 4 passes through a respective belt sleeve 55 and may extend partly or completely through the belt sleeve 55 on the opposite side of the back member 4. A sleeve 68 (FIG. 5) extends from adjacent to the bottom edge of the ear 65R to an area adjacent the opening 57 for receipt therethrough of a portion of the shoulder strap 9A. The sleeve 68 inclines downwardly and inwardly from the ear 65R toward the center and bottom portion of the back member 4 adjacent the opening 57. As shown, one end 70 (FIG. 5) of the strap 9B is permanently secured to ear 37L and releasably secured to ear 65L to permit length adjustment as with hook and loop fastener elements 72 and cooperative interengagement with a connector or fastener device 66, such as a tri-glide fastener, secured to the ear 65L. The vest 1 may be constructed for allowing a wearer to release either the right side or the left side of the vest as is desired by the wearer and as shown, is a right side release. Sleeve 68 may also be provided at the ear 65L to provide for reversibility for left side or right side release.

The illustrated cummerbund 14 (FIGS. 3, 4) is in the form of a belt with left and right side portions 69L and 69R, respectively and has a width (height as seen in the Figures) of, for example, approximately four inches. The cummerbund 14 is constructed to have adjustable length to accommodate different size wearers. As shown, each of the cummerbund side portions 69L and 69R has an end portion 71L and 71R, respectively (preferably free ends), which would be positioned at the front of the wearer and each having an attachment device 73 (FIG. 3) at the respective free end. Any suitable attachment device 73 can be used, for example, buckles, clasps, and so forth. In the illustrated structure a hook and loop fastener arrangement 74 (FIG. 4) is utilized with the hook portion of the fastener arrangement 74 on the free end portion 71 and the loop portion of the fastener arrangement 74 secured to the other of the free end portions 71. In the illustrated structure, each of the cummerbund portions 69L and 69R also has a rear end portion 75L and 75R, respectively for attachment to the lower portion of the back member 4. Preferably, both end portions 75L and 75R are constructed for non-permanent attachment to the back member 4, with at least one of the end portions 75 being configured for releasable attachment through activation of the release means 17 for quick release. It is to be understood that one of the end portions 75 may be permanently or semi-permanently attached to the vest so long as at least one portion of the cummerbund may be released from the back member 4 and the wearer in a manner later described. Preferably, both rear cummerbund end portions 75L and 75R are free ends. The end portions 75 of the cummerbund 14 may overlap inside the back member 4 and portions of the cummerbund 14 are accessible through the opening 57. The cummerbund 14 is releasably attached to the vest 1 in a manner later described whether or not the attachment device 73 is closed or open (attached or unattached).

Figure 4:
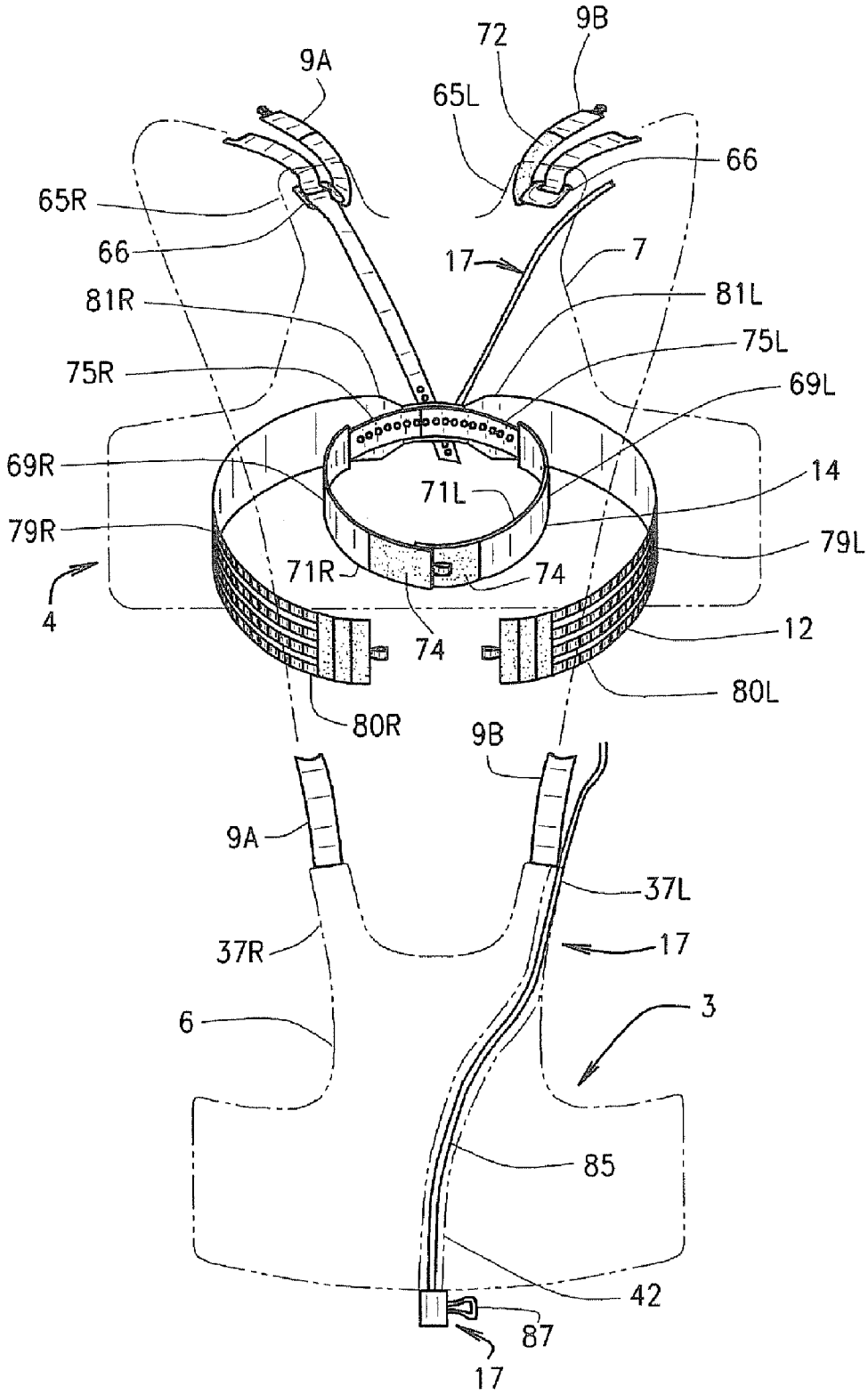
FIG. 4 is a schematic illustration of the vest of FIG. 1 showing details of the connection of various portions of the waist belt, cummerbund and a shoulder strap at the rear of the vest.
Figure 5:
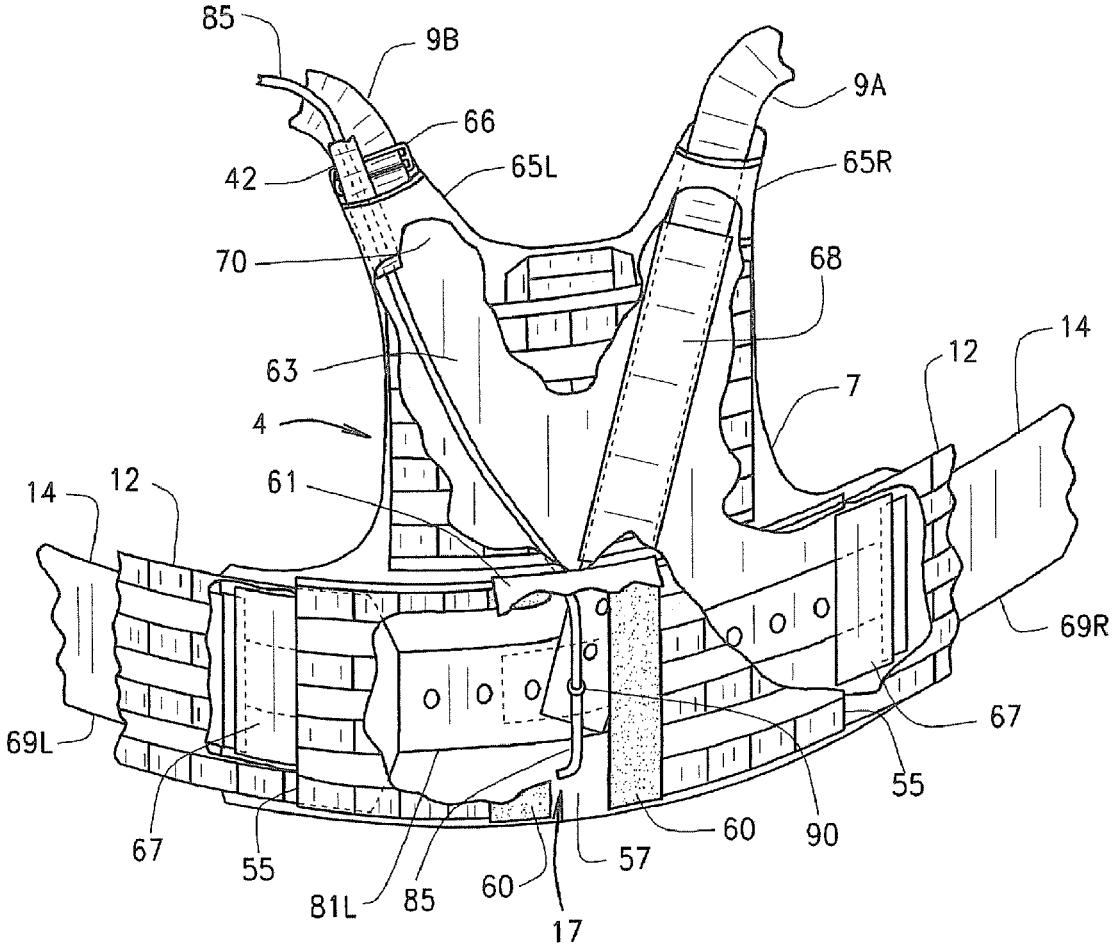
FIG. 5 is a fragmentary perspective view of the vest of FIG. 1 with portions broken away to show details of the attachment of various components at the rear of the vest.
Figure 7:
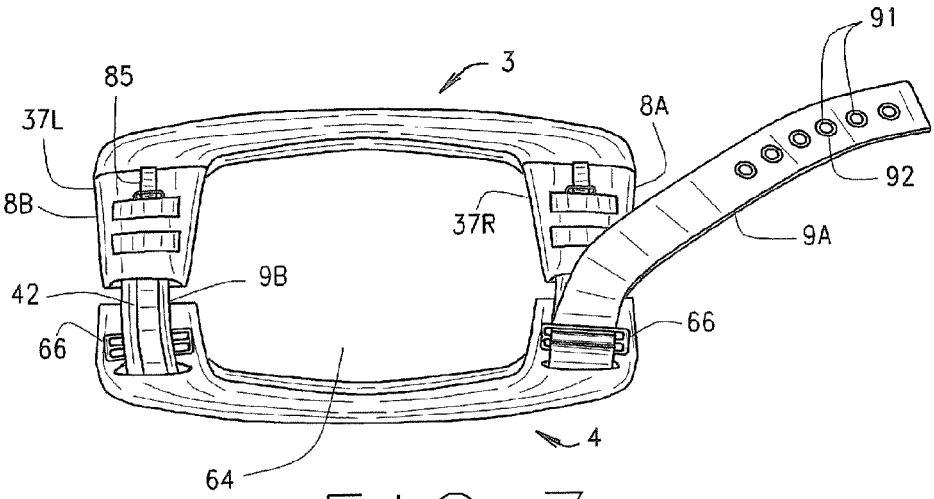
FIG. 7 is a top plan view of the vest of FIG. 1 showing an alternative method of connecting one shoulder strap for temporary mounting of the vest on the wearer.

The waist belt 12 has two side portions 79L and 79R at least one of which is selectively releasable from the back member 4. At least one of the belt side portions 79L or 79R is releasably attached to the back member 4 in a quick release manner. The side portion 79L has opposite end portions 80L and 81L, and the side portion 78R has opposite end portions 80R and 80L. The end portions 80 and 81 are preferably free ends with the end portions 80 being positioned adjacent the front of the wearer and the vest 1 and the end portions 81 being positioned at the back of the wearer and vest 1. In the illustrated embodiment, both side portions 79 of the waist belt 12 are preferably releasable from the vest 1 with one end being releasable through activation of the quick release means 17 and the other one being releasable in a separate step to, for example, permit adjustment of the length of the belt 12. The cummerbund 14 in the illustrated structure may be similarly constructed in this regard. The end portions 81 of the belt portions 79 are received through the sleeves 55 and are exposed for access through the opening 57. The belt 12 at the end portions 80 may be provided with an attachment device for securement of the belt side portions 79 to one another and preferably to the vest front member 3. As seen, hook and loop fastener elements 49 are provided allowing the end portions 80 to be releasably attached to one another and to the attachment device 40 on the front member 3. The cover 48 may also be secured in a partial covering relationship to the front member 3 through a hook and loop fastener element arrangement 49 to the exposed surface of the belt 12. The belt 12 may also be provided with vertically and horizontally extending rows of loops 22. The belt end portions 81 are received through the sleeve 55 and portions of the belt 12 are exposed for access through the opening 57. Preferably a belt end portion 81 and cummerbund end portion 75 from one side of the vest 1 overlie the belt end portion 81 and cummerbund end portion 75 from the other side of the vest. For example, the belt end portion 81R and cummerbund end portion 75R are in overlying relationship to the belt end portion 81L and cummerbund end portion 75L permitting release of one side of the belt member 12 and one side of the cummerbund 14 preferably on the same side of the vest while retaining the other side of the belt member and cummerbund attached to the vest rear member 4. It is to be understood that although a right side release is illustrated, the belt 12, cummerbund 14 and shoulder strap 9 arrangement may be configured to provide a left side release if desired. As shown, the shoulder strap 9A is configured for releasable attachment while the other shoulder strap 9B is not, although, an alternate construction would permit use of either the left or right shoulder strap for release and the other one to be semi permanently attached through suitable fastening devices such as fastener 66 and hook and loop fastener elements 72 as best seen in FIGS. 4, 5 and 7.

Figure 2:
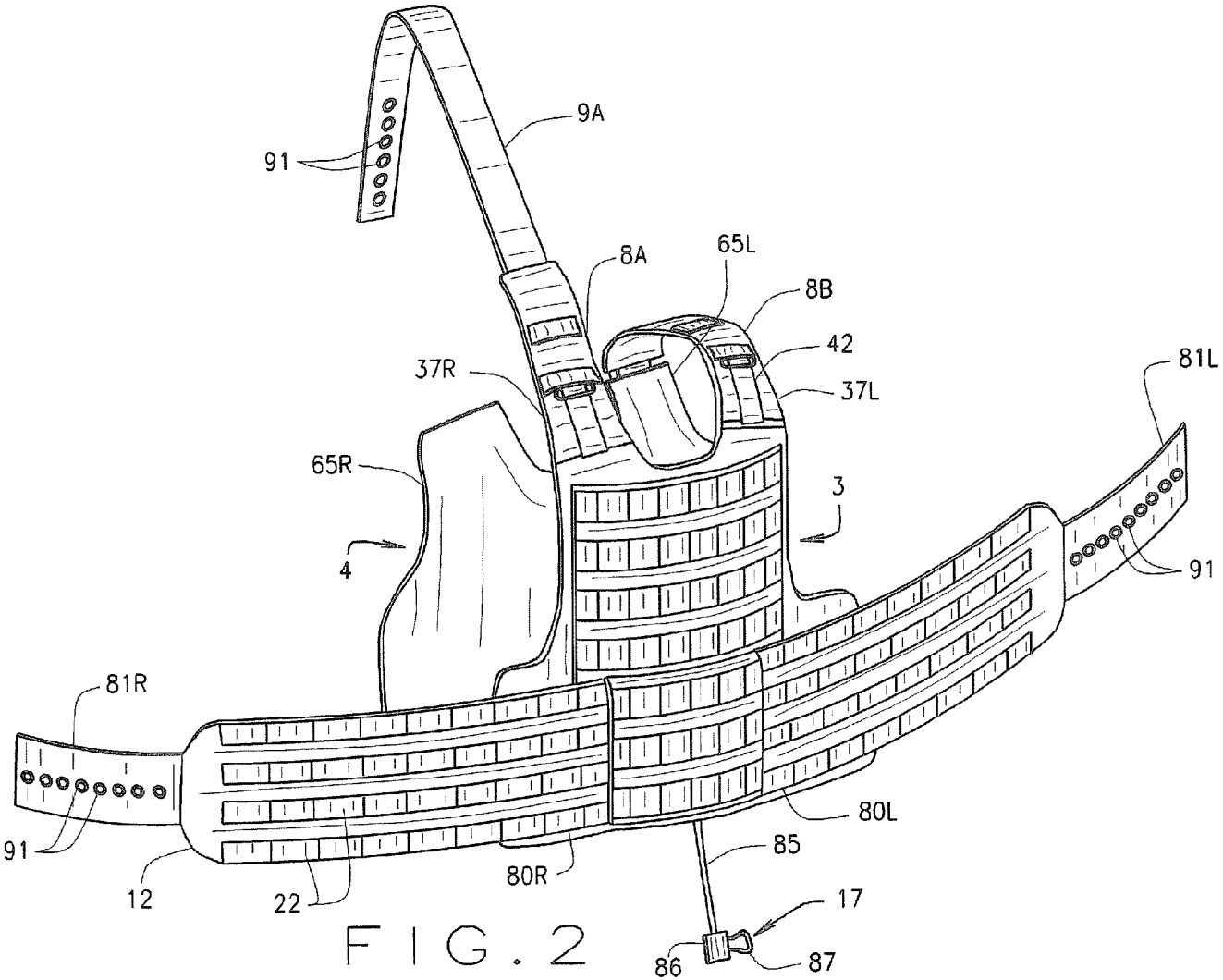
FIG. 2 is a front perspective view of the vest of FIG. 1 showing portions of the vest released to illustrate details of the vest.
Figure 6:
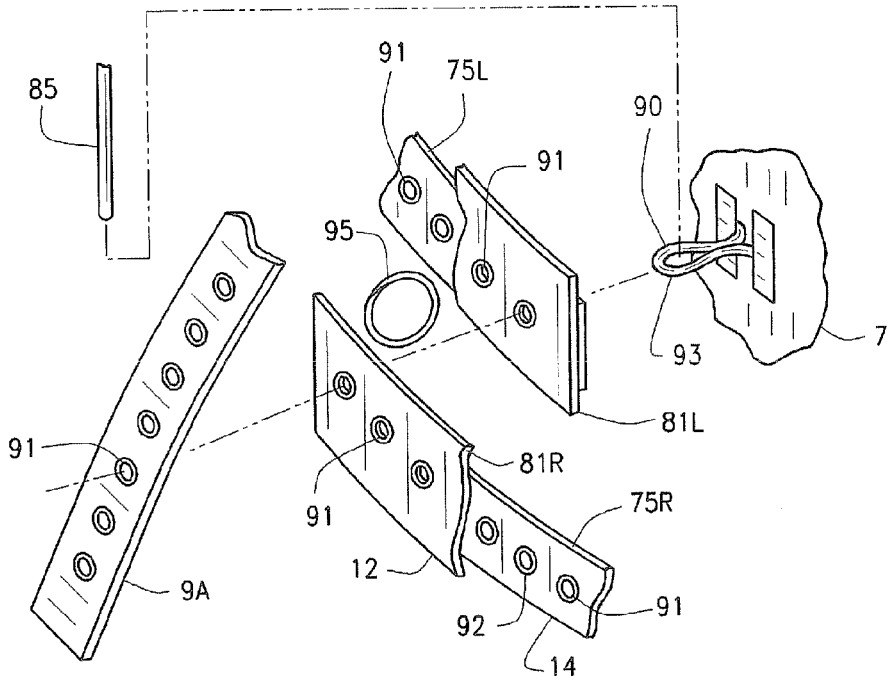
FIG. 6 is a fragmentary exploded perspective view of the rear portion of the vest of FIG. 1 showing the connection points of the cummerbund, waist belt and a shoulder strap.

The quick release system 17 (FIG. 4) is operable for selectively retaining and releasing at least one belt portion 79, at least one cummerbund portion 69 and a shoulder strap 9 from portions of the vest 1 in a manner that the vest may be quickly and easily released from a wearer in a reliable manner. In the illustrated structure, the quick release system 17 includes a flexible retainer 85 (FIG. 6) such as a plastic coated metal wire cable having a handle 87 on one end and preferably attachable to and accessible from the front torso member 3 and releasably retained in position by a fastener 86 (FIG. 2). The cable 85 is carried by both the front and rear torso panels 6 and 7 and passes through the channel 42, ear 65 and sleeve 68 and extends down to the area of the opening 57 for access by a user and is configured to releasably secure at least one end of the belt side portions 79, at least one end of the cummerbund side portions 69 and a shoulder strap 9 to the rear member 4 in a quick release manner. The quick release attachment is shown as being effected on the back torso panel 7. It is to be understood though, that the attachment in an alternate embodiment can be on the front torso panel 6. It is preferred that the attachment be made on the back torso panel 7. The quick release system 17 further includes a multi orientation and self aligning attachment device, such as a flexible fabric loop 90 (for example, the cable 85 can orient and maintain orientation of the loop 90) attached at one end to the back torso panel 7, as by sewing, and has a length sufficient to pass through one shoulder strap 9, at least one cummerbund side portion 69 and at least one belt side portion 79. As shown in FIG. 6, the loop 90 passes through the shoulder strap 9A both cummerbund end portions 75L and 75R and both belt end portions 81L and 81R which each having a plurality of spaced apart openings 91 extending longitudinally in a respective row along a portion of the length thereof for size adjustment. Preferably, the openings 91 are formed by metal eyelets 92 through which the loop 90 may be passed. In order, from inside to outside, the loop 90 passes through cummerbund end portion 75L, belt end portion 81L followed by cummerbund end portion 75R, belt end portion 81R and then strap 9A. Other sequences of these parts overlapping may be effected, for example, the strap 9A could follow belt end portion 81L. The loop 90 passes through generally aligned openings 91 and the cable 85 is then passed through the distal open end 93 of the loop 90 releasably securing the strap 9A, belt end portion 81R, cummerbund end portion 75R to the back torso panel 7. A retainer 95 is configured to retain the cummerbund end portion 75L and the belt end portion 81L to the rear torso panel 7 when the cable 85 is removed from cooperation with the loop 90. Preferably, the retainer 95 is of a type to allow manual and secondary release of the cummerbund side portion 69L and belt side portion 79L in a manner to permit adjustment of the length of the cummerbund 14 and belt 12 through the secondary release from the rear torso panel 7. In a preferred embodiment, the retainer 95 can be a split ring which can be removably mounted to the loop 90 releasably securing one belt end portion 81L and one cummerbund end portion 75L in a semi permanent but releasable manner to the rear torso panel 7. With the cable 85 out of the loop 90, the belt end portion 81R, cummerbund end portion 75R and the strap 9A are released from attachment to the back member 4 allowing the front and back members 3 and 4 to separate on one side and allowing the strap 9A to be pulled through its respective sleeve 68 whereby the front and back members 3 and 4, and hence the vest or garment 1, will under their own weight fall from the wearer, or if the front and back members do not fall from the wearer, a simple sideways push will induce the front and back members 3 and 4 to fall from the wearer while retaining the various components of the vest 1 attached to one another when the vest 1 is rigged with the retainer 95 as shown. Generally, the weight of the vest 1 and the accessories attached thereto are sufficient to effect separation of the vest 1 from the wearer when the cable 85 is no longer positioned in the loop 90. Nevertheless, removal of the cable 85 from the loop 90 effects release of the shoulder strap 9A and at least one belt and/or cummerbund end portion from attachment. The retainer 95 may be rigged differently, for example, to release both belt end portions 81 and both cummerbund end portions 75 or one belt end portion and two cummerbund end portions or both belt end portions and one cummerbund end portion. It is also recognized that the retainer 95 could likewise be configured to retain both end portions of both the belt and the cummerbund such that only the shoulder strap 9A can be quickly released when cable 85 is activated.

In the illustrated structure, the vest 1 is provided with the pair of spaced apart shoulder strap systems 8A, 8B bridging between and connecting the front and rear members 3 and 4. The strap systems 8A, 8B as shown, include the ears 65 and ears 37 in combination with a respective strap element 9A, 9B. The ears 37 may be used for cushioning if desired as can portions of the ears 65. The strap elements 9A, 9B extend between the front and rear members 3 and 4 to connect the front and rear members together. At least one of the straps, and as illustrated strap 9A, is configured for releasable attachment to the rear member 4 such that when the quick release system 17 is activated for release, partial separation of the vest 1 between the front and rear members 3 and 4 at one shoulder will happen along with release of at least one end of the waist belt 12 and at least one end of the cummerbund 14. In the illustrated embodiment, the strap element 9B has one end permanently attached to the front member 3 and attached to the rear member 4 for manual release. As shown, a tri-glide fastener 66 is secured to the rear member 4 adjacent the ear 65L allowing the strap 9B to be inserted through one opening and out of the other opening of the fastener 66 with the free end of the strap 9B then being inserted into a sleeve portion of the ear 37L. The strap 9B is preferably adjustable to allow adjustment of the shoulder portion 8B. As seen, the adjustment may be provided with hook and loop fasteners 72 secured to the strap 9B. Although the strap 9B is releasably secured to the back member 4, it does not release upon activation of the release means 17, that is, when the cable 85 is released from the loop 90. When the cable 85 is removed from the loop 90, the shoulder strap 9B remains attached, retaining the front member 3 and rear member 4 secured together. As shown, the strap 9A has one end attached to ear 37R preferably in a permanent manner as by stitching. The strap portion 9A has a plurality of metal eyelets 92 forming openings 91 for receipt of the loop 90 therethrough permitting adjustment of the length of the strap 9A over the shoulder of the wearer. When configured for operation in a quick release manner, the free end of the strap portion 9A is in its sleeve 68 in its ear 65R. The strap 9A then extends down to be adjacent the opening 57 for securement in a releasable manner with the loop 90 cooperating with the cable 85.

Once the strap 9A has been released by activation of the cable 85 and disengagement of the cable 85 with the loop 90, the strap 9A may be quickly reattached in a non-releasable manner as follows. As shown, the strap 9A may be secured to a tri-glide fastener 66 by either passing the strap 9A first through one opening for fast temporary reattachment or by passing the strap through one opening and then a second opening in the fastener 66 for more semi-permanent quick reattachment of the shoulder strap 9A in a manner that the vest may be worn by a wearer and be supported by both shoulders of the wearer. In this way, the illustrated vest may be released while maintaining the parts attached to one another but still provide for quick and positive release from a wearer. The wearer may also reattach the strap 9A after quick release to provide the ability to quickly remount the vest and exit the emergency situation wearing the vest.

The garment of the instant invention may be configured in various ways. The vest may be configured such that the cummerbund 14 may be completely released from the rear member 4 and discarded if need be or, as described above, it may remain attached at one end. Likewise, for the waist belt 12, one end may be released or both ends may be released. The belt may be retained to the front member 4 by its attachment through the hook and loop fasteners 49. By maintaining one shoulder strap attached after release of the cable 85 from the loop 90, at least the major components, that is, the front and rear members 3 and 4 remain attached for easy repossession by the wearer. Additionally, by use of the described strap 9A, the wearer of the vest may easily reassemble it, without having to open up any of the vest components contained within the opening 57 for reattachment using the cable system 17. Also, the vest 1 can be configured such that only the shoulder strap 9A is available for quick release as disclosed above. In this configuration, no belt or cummerbund need be utilized or released from a garment incorporating the teachings of the present invention.

In the illustrated embodiment, the portion of the cable 85 from the loop 90 to the wearer's shoulder moves in a generally straight line, and can easily move around the curvature of the body portions, for example, the shoulder of the wearer to effect release of the vest 1 from the wearer. Although multiple attachment points could be used, for example, the shoulder strap 9A could have its own attachment loop 90 while the belt and cummerbund end portion combinations could share a common loop or other arrangements of these points of attachment, it is preferred that the attachment is made through a single attachment point. If multiple attachment points are used in combination with a common cable 85 they are preferably generally aligned in order that the cable 85 may still move in a straight line (except for accommodating body curvature) through the attachment points.

While the attachment point is shown on the back member 4, it is to be understood that the attachment point can likewise be on the front member 3. The handle 87 is shown as positioned at the lower portion of the front member 3, however, it is to be understood that it could be positioned at different locations and still provide for remote release. One military service currently prefers that it be at the lower part of the front of the vest while another service currently prefers that it be adjacent an upper portion of the front member 3, that is, adjacent the shoulder of the wearer. In this event, multiple handles 87 could be provided on a single cable as disclosed in U.S. Pat. No. 7,020,897, or multiple cables 85 can be provided with the vest to provide the option to the wearer as to where to have the handle 87 located. The handle 87 is secured in its position by a fastener 86 to help prevent accidental release. The shoulder straps 9 are connected to the front member 3 in a permanent or semi permanent manner and releasably secured to the rear torso panel 7 with one shoulder strap preferably being free to move through its respective ear 65 by not being attached thereto. Pads (not shown) may be provided at the shoulder straps 9 to improve the comfort of the wearer when using the vest 1. The pads may be releasably mounted to the straps 9 through the use of hook and loop type fastening elements whereby the pads each wrap around a respective shoulder strap 9. While the garment is shown as including two forms of a belt, the waist belt 12 and cummerbund 14, only one may be used, for example, the waist belt 12.

Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

The invention claimed is:

1. A quick release garment comprising;

at least one attachment device;

a first shoulder strap system having a first shoulder strap portion and a second shoulder strap system having a second shoulder strap portion with said first shoulder strap portion being associated with a respective said attachment device;

a belt member having a plurality of end portions with at least one said end portion associated with a respective said attachment device;

a release system including at least one flexible retainer selectively associated with a respective said attachment device and operable to releasably secure said at least one attachment device in securing relationship to said at least one belt end portion and said first shoulder strap portion; and;

a torso member, said first shoulder strap portion and said at least one belt end portion being releasably secured to said torso member through selective cooperation between the at least one flexible retainer and the respective said attachment device, said second shoulder strap portion being fixed to the torso member such that when the at least one flexible retainer is separated from the respective attachment device said second shoulder strap portion remaining attached to the torso member.

2. The garment of claim 1 wherein at least one said attachment device and respective retainer are operable to release only one belt end portion when separated while another said end portion of the belt member remains fixed to the torso member.

3. The garment of claim 1 wherein said first and second shoulder strap portions having adjustable use length.

4. The garment of claim 3 wherein the at least one attachment device being a single attachment device secured to the torso member and the at least one flexible retainer being a single retainer associated with the single attachment device.

5. The garment of claim 4 wherein the torso member being a rear torso member.

6. The garment of claim 1 including a front torso member and wherein said torso member being a rear torso member, said first and second shoulder strap portions extending between upper portions of the front and rear torso members.

7. The garment of claim 6 wherein the at least one attachment device including a first said attachment device mounted to the rear torso member and operatively associated with the first shoulder strap portion and at least one said belt end portion, said first attachment device being operably associated with a respective said retainer to releasably secure the first shoulder strap portion and said at least one belt end portion to the rear torso member.

8. The garment of claim 7 including a connector device secured to the rear torso member and wherein one end portion of the first shoulder strap portion being secured to the front torso member, the garment further including a second attachment device associated with the first shoulder strap portion operable to releasably secure the first shoulder strap portion to the connector device when the first shoulder strap portion is free of securement to the rear torso member at said first attachment device to alternatively connect the front and rear torso members together at the first shoulder strap system.

9. The garment of claim 8 including a cummerbund having a plurality of end portions with one said cummerbund end portion being operatively associated with a respective said attachment device and respective said retainer to be releasably secured to the torso member, said cummerbund, belt member and first shoulder strap portion each having an end portion with a plurality of apertures in longitudinally spaced apart relationship, said at least one attachment device extending through an aperture in each of the first shoulder strap portion end portion, belt end portion and cummerbund end portion to fix the use length thereof.

10. The garment of claim 8 wherein the first shoulder strap portion having a first end portion and the belt member and cummerbund each having first and second end portions each having a plurality of apertures in longitudinally spaced apart relationship, at least one of said apertures in each of said first and second end portions receiving a respective said attachment device therethrough.

11. The garment of claim 10 wherein there is a single said attachment device secured to the rear torso member extending through one aperture of each of the first and second end portions releasably securing at least one of the first and second end portions to the rear torso member through selective cooperation with a respective said retainer.

12. The garment of claim 11 wherein said attachment device having a distal end and an attached end, said first and second end portions being mounted on the said attachment device with the said second end portions being positioned between the attached end and said first end portions, and the garment further including a second retainer mounted on the attachment device between the second end portions and the first end portions and operable to selectively retain the second end portions mounted to the attachment device while permitting release of the first end portions from the attachment device by removal of the at least one flexible retainer from the attachment device.

13. The garment of claim 1 including a cummerbund having a plurality of end portions with one said cummerbund end portion being operatively associated with a respective said attachment device and respective said retainer to be releasably secured to the torso member.

14. The garment of claim 13 wherein the belt member, first and second shoulder strap portions and the cummerbund each having adjustable use length.

15. The garment of claim 14 wherein the cummerbund, belt member and first shoulder strap portion each having an end portion with a plurality of apertures in longitudinally spaced apart relationship, said at least one attachment device extending through an aperture in each of the first shoulder strap portion end portion, belt end portion and cummerbund end portion to fix the use length thereof.

16. A vest comprising:

a front torso panel;

a rear torso panel;

a belt member with first and second end portions positioned adjacent the rear torso panel;

a first shoulder strap system with a first shoulder strap portion having a first end portion positioned adjacent the said belt first end portion;

a second shoulder strap system with a second shoulder strap portion extending between and connecting said front and rear torso panels together;

at least one attachment device operatively associated with at least one respective said first end portion; and at least one said retainer operatively associated with a respective said attachment device to releasably attach the first end portions to the rear torso panel and wherein separation of the at least one attachment device from a respective said retainer releases the first end portions from attachment to the rear torso panel with the second shoulder strap portion remaining connected to the front and rear torso panels.

17. A vest comprising:

a front torso member;

a rear torso member;

a first shoulder strap secured to the front torso member and having a first end positioned adjacent the rear torso member;

a second shoulder strap secured to both the front torso member and the rear torso member; and a quick release system carried by at least one of the front and rear torso members, said quick release system including a retainer and an attachment device, said retainer having a portion cooperatively associated with the attachment device for releasably attaching the first end portion of the first shoulder strap to the rear torso panel and whereby separation of the retainer from the attachment device releases the first shoulder strap from attachment to the rear torso member with the second shoulder strap maintaining connection between the front and rear torso members.

* * * * *